US007438330B2

(12) United States Patent
Takahashi

(10) Patent No.: US 7,438,330 B2
(45) Date of Patent: Oct. 21, 2008

(54) VEHICLE DOOR LOCK ACTUATOR

(75) Inventor: Akira Takahashi, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 146 days.

(21) Appl. No.: 10/720,140

(22) Filed: Nov. 25, 2003

(65) Prior Publication Data

US 2004/0108735 A1 Jun. 10, 2004

(30) Foreign Application Priority Data

Dec. 10, 2002 (JP) ..... 2002-358550

(51) Int. Cl.
*E05C 3/06* (2006.01)

(52) U.S. Cl. ..... 292/201

(58) Field of Classification Search ..... 292/201, 292/216, DIG. 23, 210, DIG. 22, DIG. 65; 70/279.1, 264
See application file for complete search history.

(56) References Cited

U.S. PATENT DOCUMENTS 4,518,181 A * 5/1985 Yamada ..... 292/201
4,926,707 A 5/1990 Yamada
5,409,277 A * 4/1995 Rogers et al. ..... 292/336.3
5,649,726 A * 7/1997 Rogers et al. ..... 292/201
6,082,158 A * 7/2000 Wegner ..... 70/277
6,208,103 B1 * 3/2001 Kachouh ..... 318/468
6,519,987 B1 * 2/2003 Weyerstall ..... 70/257
6,557,387 B2 * 5/2003 Kachouh ..... 70/279.1
6,557,911 B2 * 5/2003 Nelsen et al. ..... 292/216

FOREIGN PATENT DOCUMENTS

JP 62-258076 11/1987
JP 63-067167 5/1988
JP 5-52150 U 7/1993
JP 2513398 Y2 7/1996
JP 2529569 Y2 12/1996
JP 2002-534621 10/2002
WO 99/13188 3/1999

* cited by examiner

*Primary Examiner*—Chuck Y. Mah
(74) *Attorney, Agent, or Firm*—Sughrue Mion, PLLC

(57) ABSTRACT

An actuator for a vehicle, in particular for an automobile door lock includes a rotatable rotor; a lever that is disposed so as to be swingable between a first position and a second position; and an engagement mechanism through which the lever is engaged with the rotor. The engagement mechanism also includes a protrusion that engages with the rotor; and a guide mechanism that makes, along with rotation of the rotor, the lever swing between the first position and the second position, and allows, when the rotor stops rotating, a movement of the lever without turning the rotor.

4 Claims, 8 Drawing Sheets

VEHICLE DOOR LOCK ACTUATOR

BACKGROUND OF THE INVENTION

1) Field of the Invention

The present invention relates to an actuator for a vehicle, and more specifically, to an actuator for a door locking device of a four-wheel automobile.

2) Description of the Related Art

It is a common practice to provide a door locking device between an outside handle and a latch mechanism of a door provided in the chassis of the automobile. The latch mechanism normally includes a latch and a ratchet. When the automobile door is shut against the chassis, the latch engages in a striker provided on the chassis and the ratchet maintains this locked state.

The door locking device is locked and unlocked in a switchable manner by manual operation or electronic control. The manual operation involves using a key on the externally provided key cylinder or from within the chassis by pushing a locking button provided inside. The electronic control is performed, for example, by a so-called keyless entry with a remote controller.

The door locking device allows, when being in an unlocked condition, the door to be opened with the outside handle. Concretely, the ratchet releases its hold on the latch and the striker, thus enabling the door to be opened.

On the other hand, the door locking device does not allow, when being in a locked condition, the door to be opened with the outside handle. In other words, the ratchet maintains its hold on the latch and the striker.

Such a door locking mechanism includes an actuator disclosed in, for example, Japanese Utility Model Laid-Open Publication No. H5-52150, Japanese Utility Model No. 2513398, and Japanese Utility Model No. 2529569. FIG. 8 is a plan view of a conventional actuator. The actuator 100 includes a driving motor 110, a worm wheel 120, and an output lever 130.

The driving motor 110 is housed in a casing 1 and can turn both clockwise and counter-clockwise. The driving motor 110 is driven according to the electronic control, and has a driving shaft 1110 and a cylindrical worm 1120 mounted on the driving shaft 1110. The driving shaft 1110 and the worm 1120 turn in unison.

The worm wheel 120 is disc-shaped and is housed in the casing 1. The worm wheel 120 is rotatably supported by a supporting shaft 1210. The worm wheel 120 is engaged with the worm 1120 at a periphery of the worm wheel 120. Consequently, the worm wheel 120 is a rotor that turns in a normal direction or the opposite direction through the worm 1120 driven by the driving motor 110. The worm wheel 120 is illustrated in FIG. 8 as a rotor that turns clockwise or counter-clockwise. The worm wheel 120 is provided with a protrusion 200 that projects from the worm wheel 120.

The fan-shaped output lever 130 is swingably supported by an output shaft 1310 disposed on one side of the worm wheel 120. Precisely, the output lever 130 gradually broadens from a base 1320 of the output lever 130 towards a front end 1330 of the output lever 130. The base 1320 is shaft-supported and the front end 1330 swings freely. A groove 300 into which the protrusion 200 of the worm wheel 120 engages is provided on the front end 1330 that faces the worm wheel 120.

On the output shaft 1310 that shaft-supports the output lever 130, an output arm 1340 is shaft-supported. The output arm 1340 moves in unison with the output lever 130 through the output shaft 1310. The output arm 1340 is connected to a locking lever 140 which is a switching member. The locking lever 140 switches the door locking device between locked and unlocked condition by switching between a locked position and an unlocked position.

The actuator 100 electronically works in the manner described below when the door locking device is in a locked condition (that is, when the locking lever 140 is in the locked position). The driving motor 110 is driven to turn the worm wheel 120 in counter-clockwise direction. By this action the protrusion 200 of the worm wheel 120 engages in a first contact portion 300*a* of the groove 300 of the output lever 130. Once the worm wheel 120 and the output lever 130 are engaged in this fashion, further counter-clockwise rotation of the worm wheel 120 makes the protrusion 200 push the first contact portion 300*a* and makes the output lever 130 swing counter-clockwise. The output lever 130 switches the locking lever 140 to the unlocked position through the output arm 1340 which turns in unison with the output lever 130. Thus, the door locking device is in an unlocked condition. When the worm wheel 120 turns a complete 360 degrees and the protrusion 200 is back in its original position, the driving motor 110 ceases its operation.

The actuator 100 electronically works in the manner described below when the door locking device is in an unlocked condition (that is, when the locking lever 140 is in the unlocked position). The driving motor 110 is driven to turn the worm wheel 120 in clockwise direction. By this action the protrusion 200 of the worm wheel 120 engages in a second contact portion 300*b* of the groove 300 of the output lever 130. Once the worm wheel 120 and the output lever 130 are engaged in this fashion, further clockwise rotation of the worm wheel 120 makes the protrusion 200 push the second contact portion 300*b* and makes the output lever 130 swing clockwise. The output lever 130 switches the locking lever 140 to the locked position through the output arm 1340 which turns in unison with the output lever 130. Thus, the door locking device is in a locked condition. In this case too, when the worm wheel 120 turns a complete 360 degrees and the protrusion 200 is back in its original position, the driving motor ceases to be driven.

In the case of manual operation such as by insertion of key into the key cylinder or operation of the inside locking button, the locking lever 140 switches between the locked position and the unlocked position by a linking unit such as a link or a wire that links the locking lever 140 and the key cylinder or the inside locking button. The door locking device switches between locked and unlocked state in accordance with the locked or unlocked position of the locking lever 140. The actuator works in the following manner under such circumstances. The output lever 130 swings in unison with the output arm 1340 in accordance with the locked or unlocked position of the locking lever 140, while the protrusion 200 of the worm wheel 120 shifts in the groove 300. As a result, the output lever 130 stops at a predetermined position. Consequently, the switching of position of the locking lever by manual operation does not get transmitted to the worm wheel 120.

In the conventional actuator 100, the protrusion 200 provided on the worm wheel 120 moves in the groove 300 provided in the output lever 130 upon manual operation or electronic control of the door locking device. Consequently, it is necessary to have a fan-shaped output lever 130 which is sufficiently broad. In addition, it is necessary to make the sliding area of the output lever 130 to also cover the area outside of the perimeter of the worm wheel 120. Hence, the actuator cannot be made compact.

SUMMARY OF THE INVENTION

It is an object of the present invention to at least solve the problems in the conventional technology.

An actuator for a vehicle according to an aspect of the present invention includes a rotatable rotor; a lever that is disposed so as to be swingable between a first position and a second position; and an engagement mechanism through which the lever is engaged with the rotor, the engagement mechanism including a protrusion that engages with the rotor; and a guide mechanism that makes, along with rotation of the rotor, the lever swing between the first position and the second position, and allows, when the rotor stops rotating, a movement of the lever without turning the rotor.

The other objects, features and advantages of the present invention are specifically set forth in or will become apparent from the following detailed descriptions of the invention when read in conjunction with the accompanying drawings.

DETAILED DESCRIPTION

Exemplary embodiments of an actuator for a vehicle according to the present invention will be explained below with reference to the accompanying drawings. For the sake of convenience, an actuator for a door locking device will be explained as a specific example of the actuator for an automobile door lock.

Figure 1:
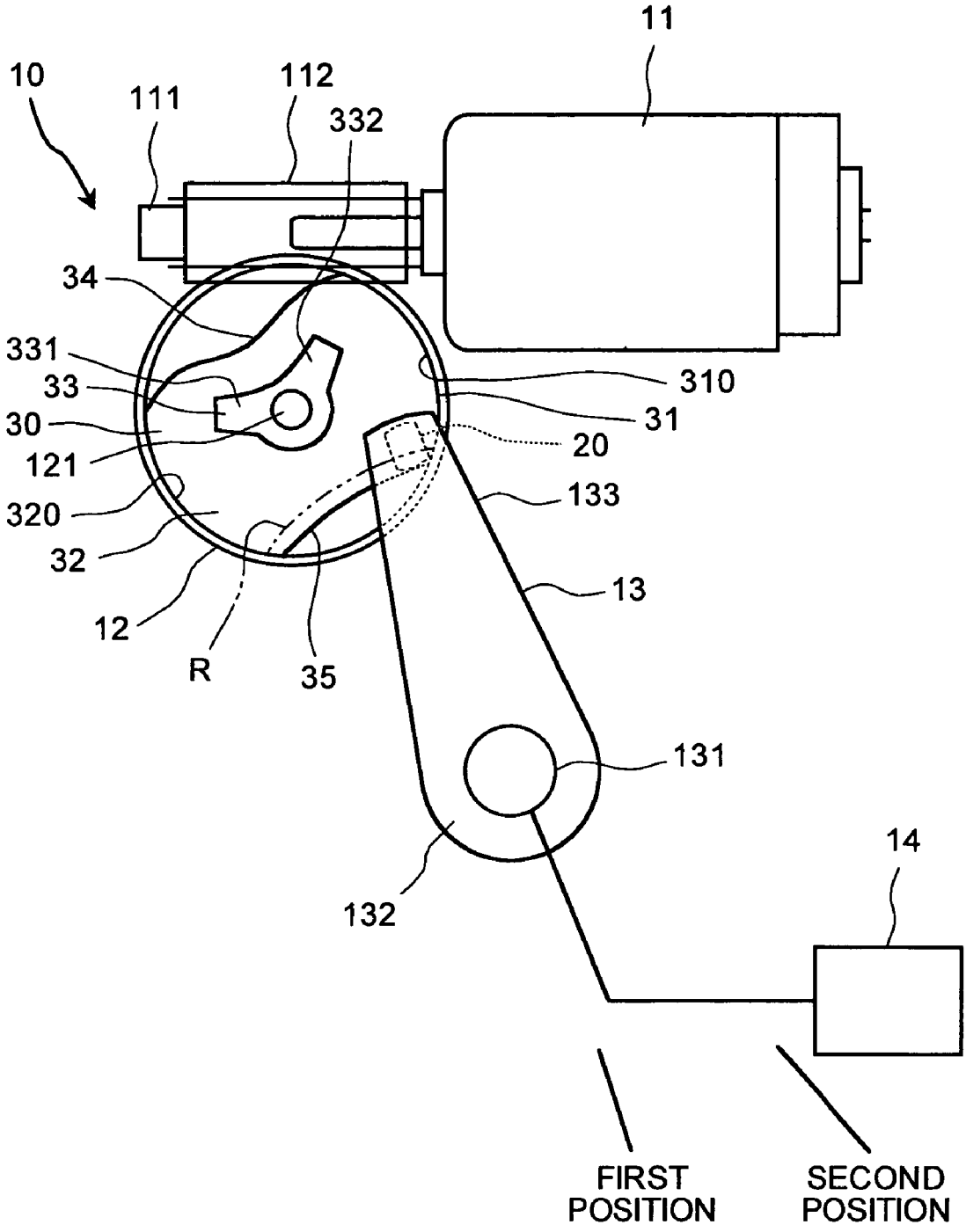
FIG. 1 is a plan view illustrating the main parts of an actuator for a door locking device (an automobile part) according to the present invention.

FIG. 1 is a plan view illustrating the main parts of the actuator for a door locking device (automobile part) according to the present invention. FIG. 2 through FIG. 7 are plan views illustrating the mechanism of the actuator shown in FIG. 1. In FIG. 1 through FIG. 7, the actuator 10 includes a driving motor 11, a worm wheel 12, and an output lever 13.

The driving motor 11 is housed in a not shown casing and can turn both clockwise and counter-clockwise. The driving motor 111 is driven electronically, and has a driving shaft 111 and a cylindrical worm 112 mounted on the driving shaft 111. The driving shaft 111 and the worm 112 turn in unison.

The worm wheel 12 is disc-shaped and is housed in a casing. The worm wheel 12 is rotatably supported by a supporting shaft 121. One portion of the worm wheel 12 is engaged with the worm 112. Consequently, the worm wheel 12 is a rotor that turns in a normal direction or the opposite direction through the worm 112 driven by the driving motor 11. The worm wheel 12 is illustrated in FIG. 1 as a rotor that turns clockwise or counter-clockwise. A groove (an engaging guiding member) 30, which is a part of an engaging unit, is formed on worm wheel 12.

The output lever 13 is shaft-supported by an output shaft 131 disposed on a predetermined position on one side of the worm wheel 12, and is swingable. Precisely, a base 132 of the output lever 13 is shaft-supported by the output shaft 131 disposed away from the driving motor 11 and the worm wheel 12. A front end 133 of the output lever 13 swings freely. In other words, the output lever 13 slides between a first position in FIG. 1 and a second position in FIG. 7. The output lever 13 shown in the drawings broadens gradually from the base 132 to the front end 133. The base 132 is connected to a locking lever 14 which is a switching member. The locking lever 14 switches the door locking device between a locked position and an unlocked position. To be more specific, when the output lever 13 is at the first position (see FIG. 1), the locking lever 14, which is connected to the output lever 13, is in the unlocked position, and when the output lever 13 is at the second position (see FIG. 7), the locking lever 14 is in the locked position.

A protrusion 20 projects toward the worm wheel 12 from the portion of the front end 133 of the output lever 13 that faces the end facet of the worm wheel 12. The protrusion 20 along with the groove 30 forms the engaging unit.

In the actuator 10 according to the present invention, the protrusion 20 on the output lever 13 moves within the groove 30 provided in the worm wheel 12. The output lever 13 engages with the worm wheel 12 when the protrusion 20 engages into the groove 30. The groove 30 includes a first sliding member 31, a second sliding member 32, a contact member 33, a guiding member 34, and an allowing member 35. The first sliding member 31 has a first sliding surface 310 along the outer periphery of the worm wheel 12, and the second sliding member 32 has a second sliding surface 320 along the outer periphery of the worm wheel 12. The first sliding surface 310 and the second sliding surface 320 face each other with a supporting shaft 121 between them. When the worm wheel 12 turns, the first sliding member 31 and the second sliding member 32 slide and come in contact with the protrusion 20 of the output lever 13 and guide the protrusion 20 to the guiding member 34 and the allowing member 35, respectively.

The contact member 33 is pinned on the worm wheel 12 by the supporting shaft 121. The contact member 33 includes a first contact member 331 and a second contact member 332 which extend in different directions with respect to the supporting shaft 121.

When the worm wheel 12 turns clockwise, the first contact member 331 attaches with the protrusion 20 of the output lever 13 and swings the output lever 13 counter-clockwise. The first contact member 331 is disposed in such a way that it does not attach with the protrusion 20 when due to the turning of the worm wheel 12 the protrusion 20 is moving along the second sliding surface 320.

When the worm wheel 12 turns counter-clockwise, the second contact member 332 attaches with the protrusion 20 of the output lever 13 and swings the output lever 13 clockwise. The second contact member 332 is disposed in such a way that it does not attach with the protrusion 20 when due to the turning of the worm wheel 12 the protrusion 20 is moving along the first sliding surface 310.

The guiding member 34 is disposed between and in continuation with the first sliding member 31 and the second sliding member 32. When the worm wheel 12 turns clockwise, the guiding member 34 guides the protrusion 20 that slides from the first sliding member 31 so that the protrusion 20 comes in contact with the first contact member 331, and when the worm wheel 12 turns counter-clockwise, the guiding member 34 guides the protrusion 20 that slides from the second sliding member 32 such that the protrusion 20 comes in contact with the second contact member 332.

The allowing member 35 (allowing means) is disposed in continuation with the first sliding member 31 and the second sliding member 32 and facing the guiding member 34, with the supporting axis 121 (the contact member 33) disposed in between. The allowing member 35 has an arc track R with the output shaft 131 as its center. The allowing member 35 allows the movement of the protrusion 20 of the output lever 13 when the output lever 13 slides between the first position and the second position at the time when the worm wheel 12 is not turning.

The actuator 10 that has the structure described above works in the manner described below when operated electronically and manually. An electronic control of the actuator 10 will be explained followed by explanation of manual operation. The electronic control refers to the so-called keyless entry involving usage of a remote controller for locking and unlocking the door locking device in a switchable manner.

As illustrated in FIG. 1, the output lever 13 and the worm wheel 12 are engaged when the protrusion 20 at a position (hereinafter also "first halting position") near the first sliding position 31 in the allowing member 35 of the groove 30. When the output lever 13 and the worm wheel 12 are engaged, the output lever 13 is in the first position and the locking lever 14 which is connected to the output lever 13 is in the unlocked position. Consequently, the door locking mechanism is in the unlocked condition.

When the driving motor 11 is driven electronically, the worm wheel 12 turns clockwise through the driving shaft 11 and the worm 112. When the worm wheel 12 turns a complete 360 degrees, the driving motor 11 ceases to be driven.

Figure 2:
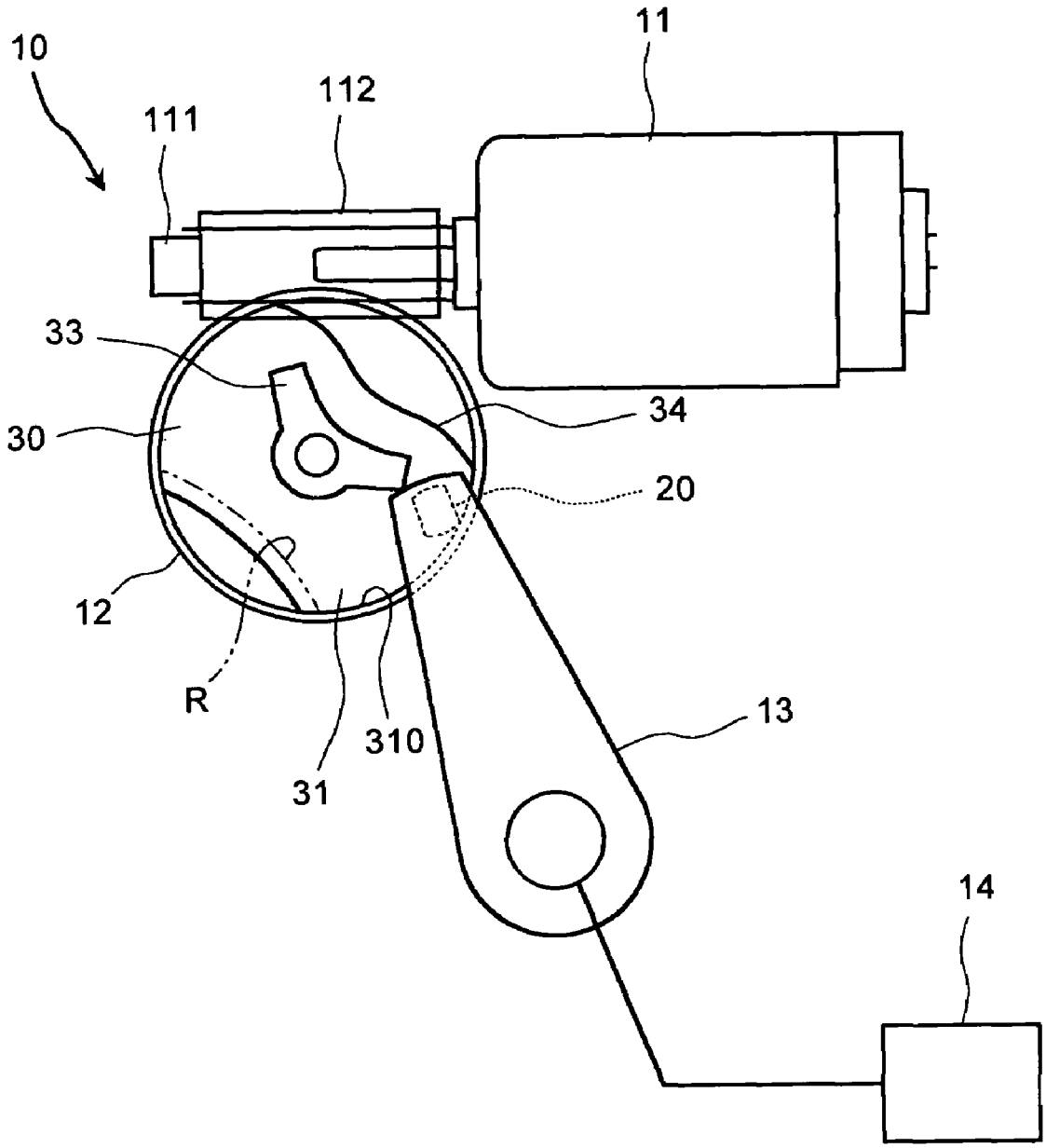
FIG. 2 is a plan view illustrating the mechanism of the actuator.
Figure 3:
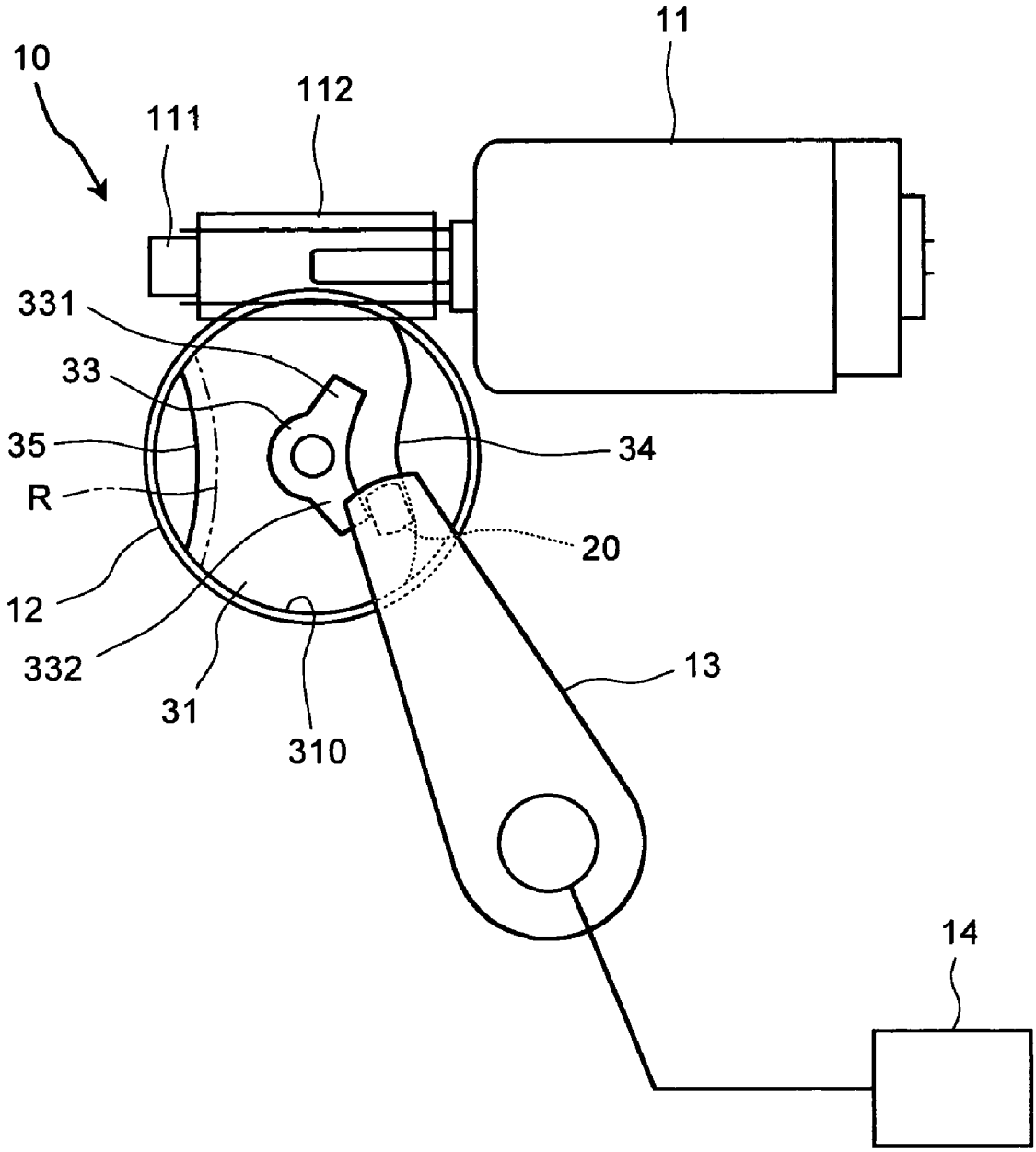
FIG. 3 is a plan view illustrating the mechanism of the actuator.

When the worm wheel 12 turns clockwise, as shown in FIG. 2, the protrusion 20 of the output lever 13 moves along the first sliding surface 310 of the groove 30 of the worm wheel 12. When the worm wheel 12 turns further clockwise, as shown in FIG. 3, the protrusion 20 moves from the first sliding surface 310 to the guiding member 34.

Figure 4:
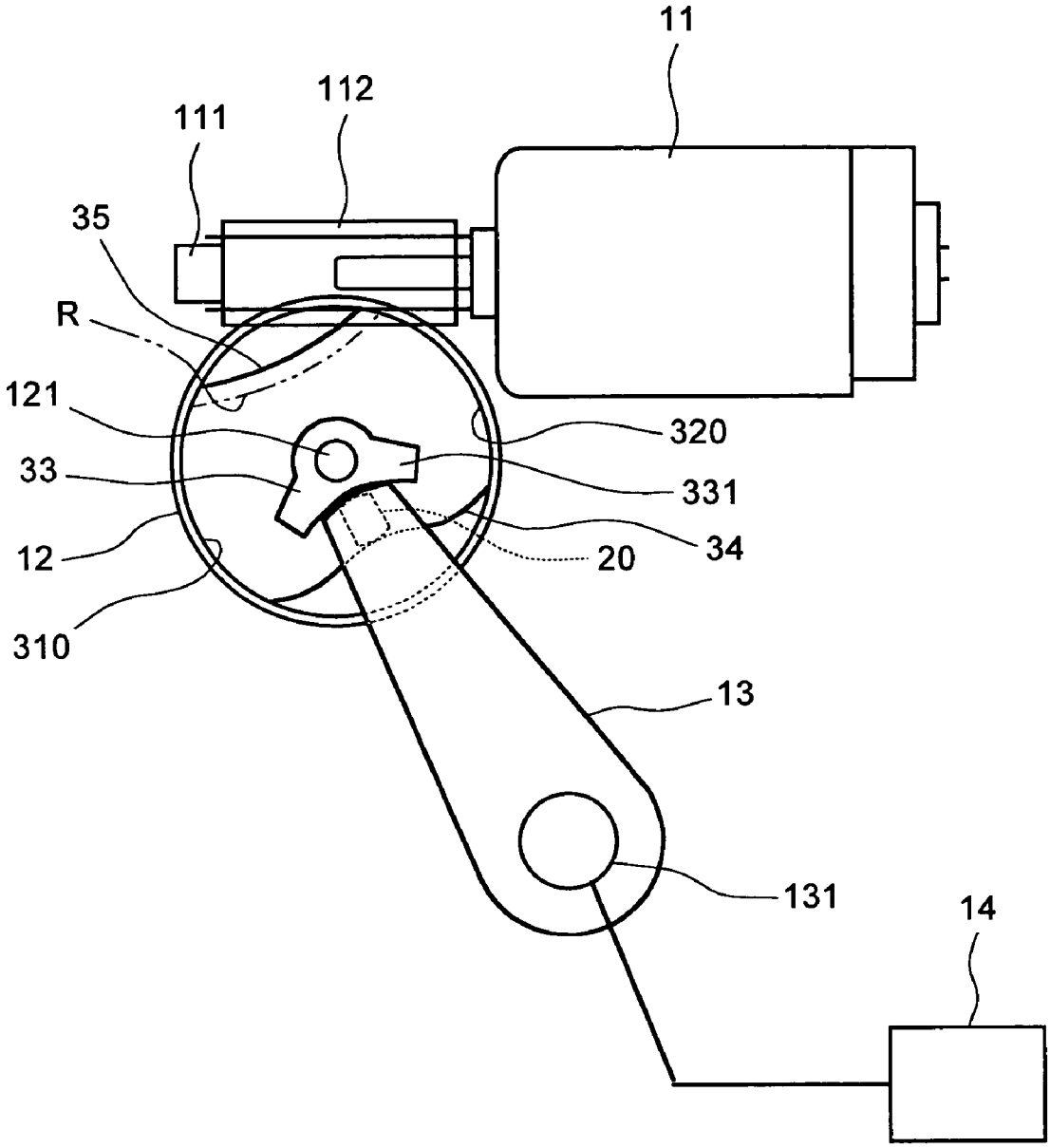
FIG. 4 is a plan view illustrating the mechanism of the actuator.
Figure 5:
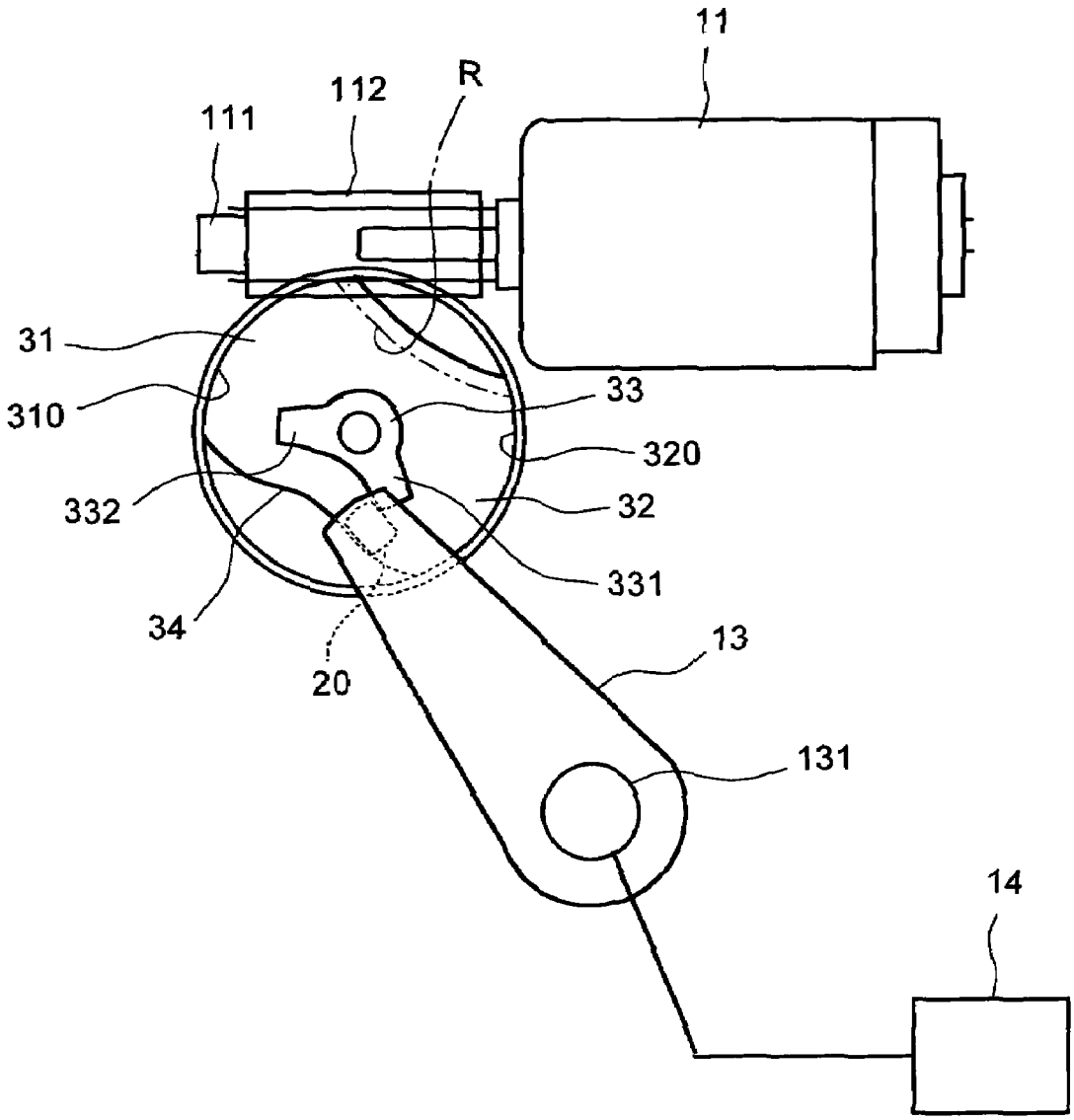
FIG. 5 is a plan view illustrating the mechanism of the actuator.

Upon further turning of the worm wheel 12, as shown in FIG. 4, the protrusion 20 that has moved to the guiding member 34 is further guided by the guiding member 34 to the first contact member 331. The protrusion thus guided to the first contact member 331 comes in contact with the first contact member 331 by further turning of the worm wheel 12, as shown in FIG. 5. This action swings the output lever 13 counter-clockwise.

Figure 6:
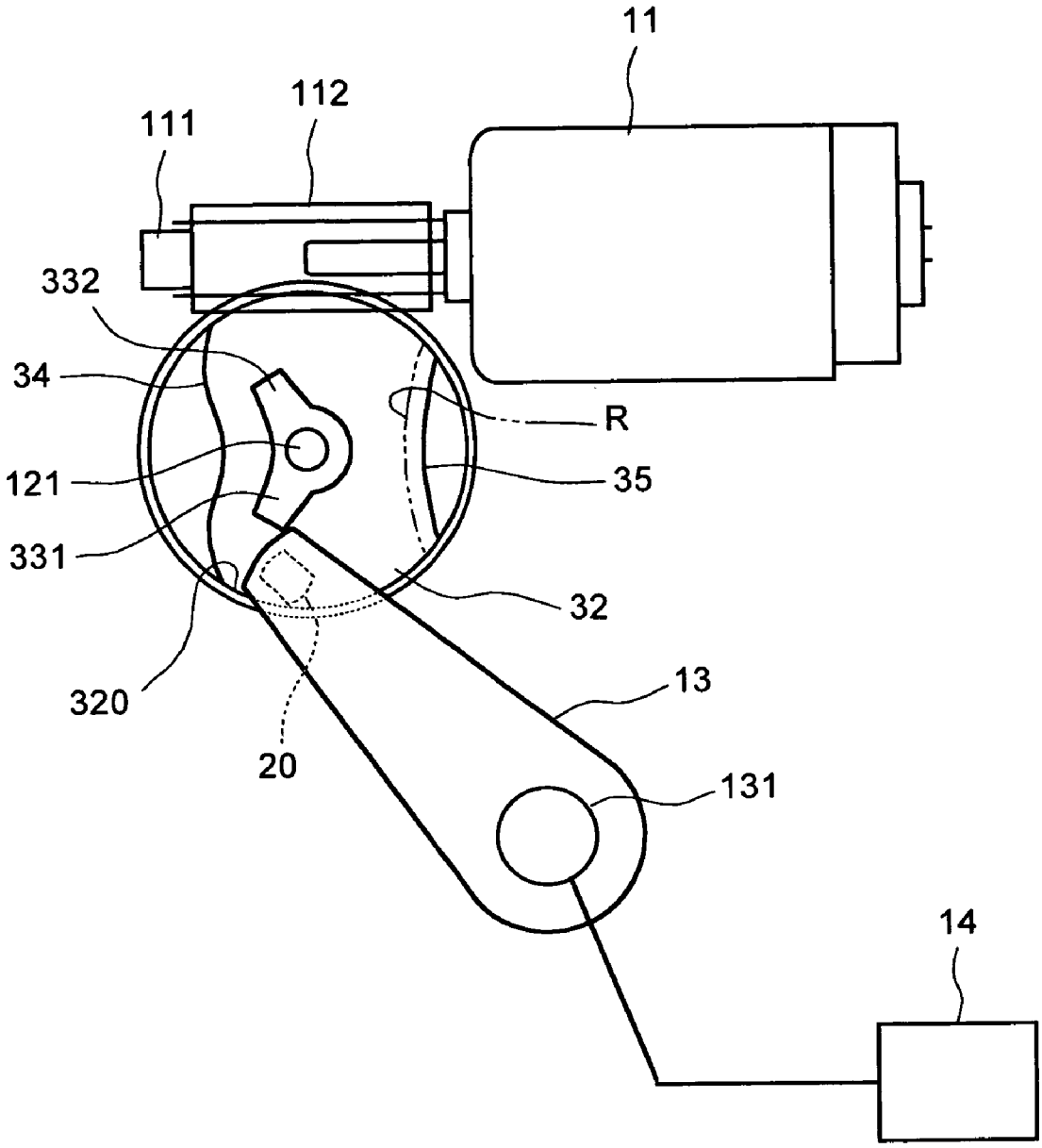
FIG. 6 is a plan view illustrating the mechanism of the actuator.
Figure 7:
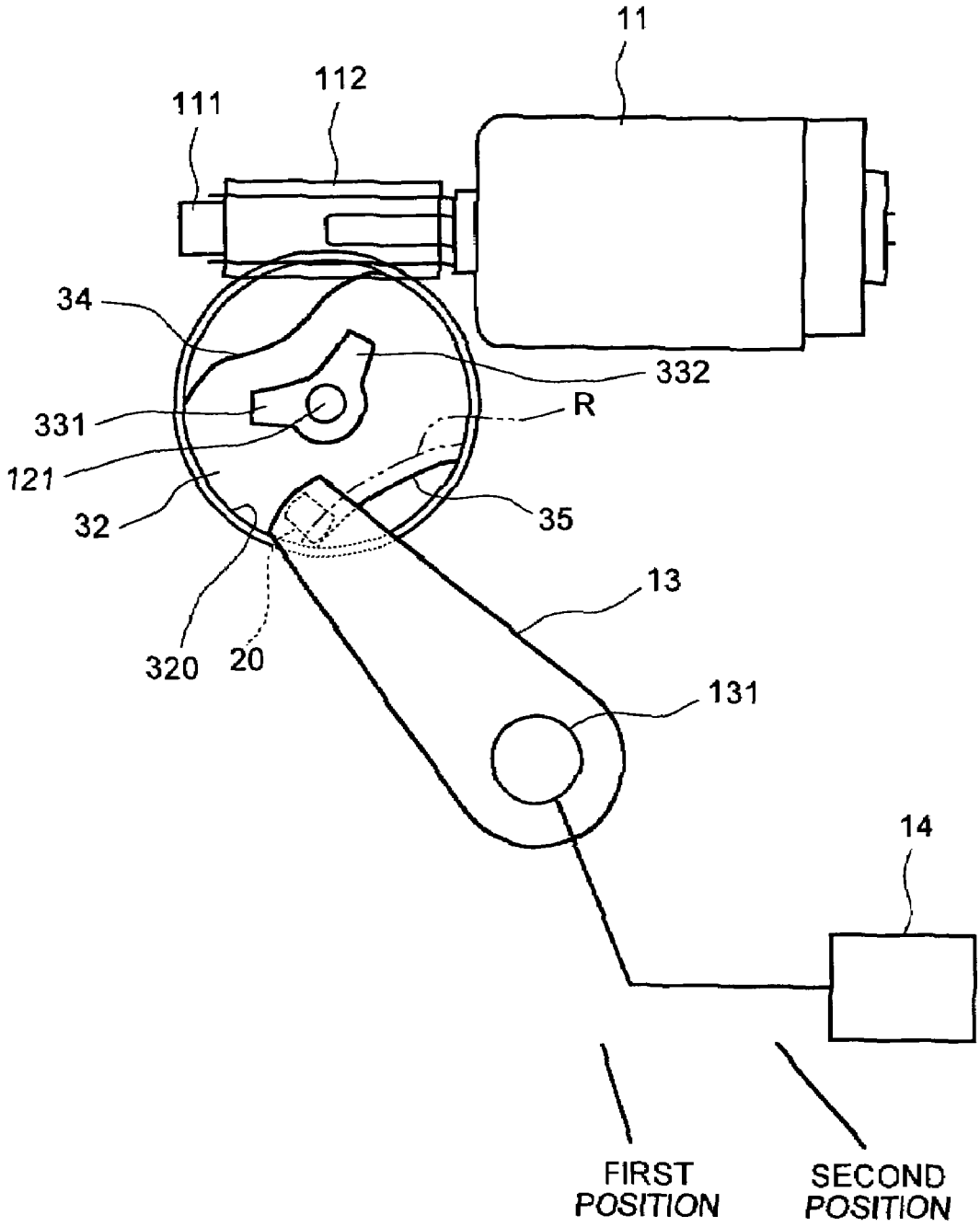
FIG. 7 is a plan view illustrating the mechanism of the actuator.
Figure 8:
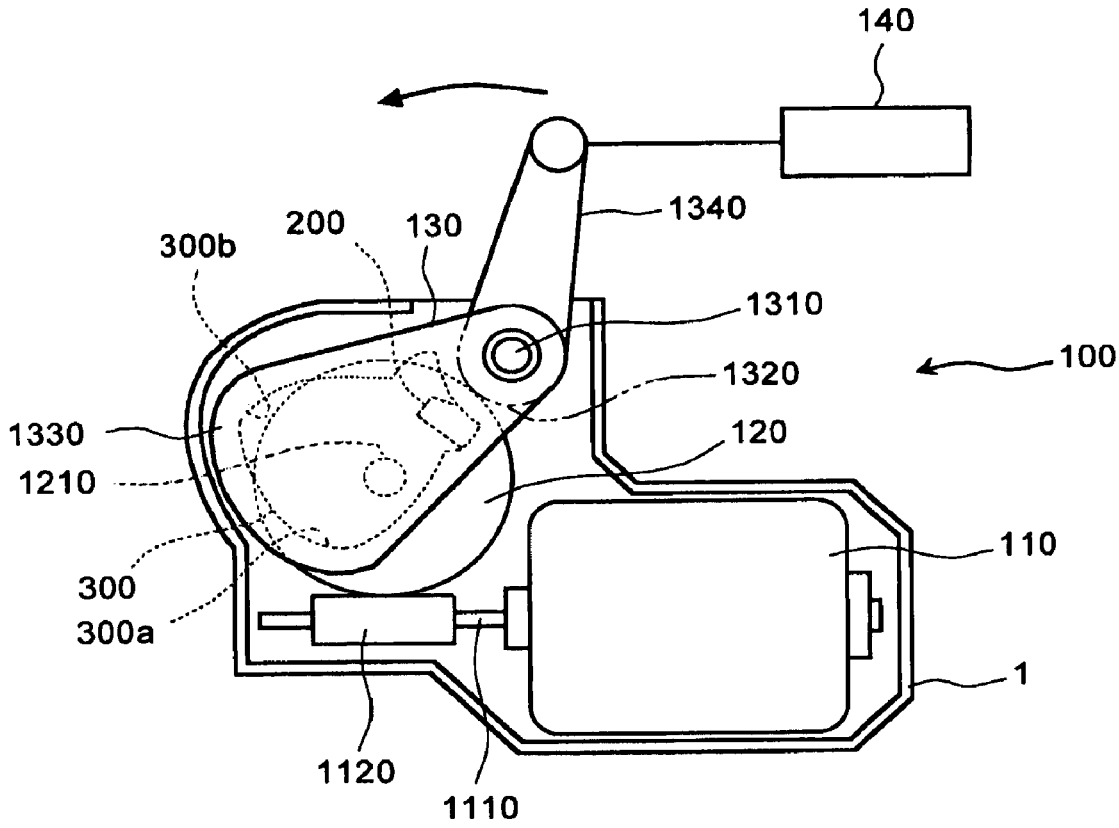
FIG.8 PRIOR ART
FIG. 8 is a plan view illustrating a conventional actuator.

Upon further turning of the worm wheel 12, the protrusion which is in contact with the first contact member 331 moves along the second sliding surface 320, as shown in FIG. 6, and comes in contact with the allowing member 35, as shown in FIG. 7. At this point, the worm wheel 12 completes a full 360 degrees, and stops turning. As a result, the driving motor 11 ceases to be driven. Consequently, the output lever 13 and the worm wheel 12 are engaged with the protrusion 20 of the output lever 13 at a position (hereinafter also "second halting position") near the second sliding member 32 on the allowing member 34 of the groove 30. The output lever 13 is thus in the second position. Therefore, the locking lever 14, which is connected to the output lever 13, switches to the locked position, thus leaving the door locking device in the locked state.

Explained below is the working of the actuator 10 when the door locking device changes from the locked to the unlocked condition electronically.

When the output lever 13 and the worm wheel 13 are engaged with the protrusion of the output lever 13 at the second halting position, or in other words, when the output lever 13 is in the second position, the driving motor 11 is electronically driven to turn the worm wheel 12 counter-clockwise. Due to the turning of the worm wheel 12, the protrusion 20 of the output lever 13 moves along the second sliding surface 320 and reaches the guiding member 34. Further turning of the worm wheel 12, the protrusion 20 is guided by the guiding member 34 into the second contact member 332. When the protrusion 20 comes in contact with the second contact member 332, the output lever 13 swings clockwise. When the worm wheel 12 turns further, the protrusion 20 moves along the first sliding surface 310 and comes in contact with the allowing member 35. With this, the worm wheel completes a full 360 degrees turn and stops turning. As a result, the driving motor 11 ceases to be driven. Consequently, the output lever 13 and the worm wheel 12 are now engaged with the protrusion 20 of the output lever 13 at the first halting position. The output lever 13 is thus in the first position. Therefore, the locking lever 14, which is connected to the output lever 13, switches to the unlocked position, thus leaving the door locking device in the unlocked state.

The working of the actuator 10 when operated manually will be described next. Manual operation refers to using a key on the externally provided key cylinder or from within the chassis by pushing a locking button provided inside in order to lock and unlock the door locking device in a switchable manner. Precisely, the door locking device is rendered in a locked or unlocked state in a switchable manner by switching the position of the locking lever 14 between the locked and unlocked position.

In the case of manual operation, the driving motor 11 of the actuator 10 is not driven and hence the worm wheel also does not turn. Therefore, while the locking lever 14 is switched between the unlocked and the locked position by manual operation, the output lever 13 which is connected to the locking lever 14 slides between the first position and the second position.

When the locking lever 14 is in the unlocked position (that is, when the door locking device is in the unlocked state), the output lever 13 of the actuator 10 is in the first position as shown in FIG. 1, and the protrusion 20 is in the first halting position.

When the locking lever 14 is switched from the unlocked position to the locked position by manual operation, the output lever 13 swings counter-clockwise. In other words, the output lever 13 slides from the first position to the second position. When the output lever 13 slides, the protrusion 20 of the output lever 13 slides along the arc track R from the first halting position to the second halting position and stops there.

When the locking lever 14 is switched from the locked position to the unlocked position by manual operation, the protrusion 20 of the output lever 13 slides along the arc track R from the second halting position to the first halting position and stops there. This sliding of the protrusion 20 is not transmitted to the worm wheel 12. Consequently, the manual switching of the locking lever between the locked and unlocked position can be carried out smoothly.

To sum up, in the actuator 10 according to the present invention, by providing a mechanism in which the protrusion 20 provided in the front end 133 of the output lever 13 engages into and slides in the groove 30 provided on the end facet of the worm wheel 12 and thereby engaging the output lever 13 and the worm wheel 12, a compact output lever 13 can be realized since the width of the output lever 13 need not exceed the size of the protrusion 20.

In the actuator 10 according to the present invention, by providing a mechanism in which the protrusion 20 provided in the front end 133 of the output lever 13 engages into and slides in the groove 30 provided on the end facet of the worm wheel 12 and thereby engaging the output lever 13 and the worm wheel 12, the sliding area of the output lever 13 can be restricted within the perimeter of the worm wheel 12. Consequently, the actuator 10 can be made compact.

In the actuator 10 according to the present invention, the locking lever 14 can be switched between the locked and unlocked state by the turning of the worm wheel 12 to a full 360 degrees and by the sliding of the output lever 13 that engages with the worm wheel 12. Consequently, the need for an elastic body such as a spring, and the like, for returning the worm wheel 12 to a neutral position is obviated.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An actuator for a vehicle, comprising:

a rotor that is rotatable;

a driving motor configured to rotate the rotor through a driving shaft and a worm, wherein when the rotor turns a complete 360 degrees the driving motor stops;

a lever that is swingable, having a front end that moves between a first halting position and a second halting position of the position of the rotor, wherein a back end of said lever is engaged with a locking member, and said first halting position corresponds to an unlocked position of the locking member and said second halting position corresponds to a locked position of the locking member; and an engagement mechanism through which the lever is engaged with the rotor, the engagement mechanism including:

a protrusion disposed on the front end of said lever configured to engage with the rotor; and a guide mechanism disposed on the rotor configured to make, upon completion of a full 360° rotation of the rotor, the front end of the lever swing between the first halting position and the second halting position, and allows, when the rotor stops rotating, a movement of the lever without turning the rotor, wherein the guide mechanism includes:

an allowing means for allowing, when the rotor stops rotating, a movement of the protrusion without turning the rotor, the movement being between a first halting position and a second halting position, wherein the first halting position is located at one end of the allowing means and the second halting position is located at an opposite end of the allowing means, wherein before rotation of the rotor, the rotor is at an original position and the front end of the lever is positioned in one of the first halting position and the second halting position, and when the rotor is returned to the original position at conclusion of one full 360° rotation of the rotor, the front end of the lever rests in an other one of the first halting position and the second halting position, wherein the allowing means includes an arc shaped portion disposed between the first halting position and the second halting position, and wherein the arc shape has an output shaft as its center, wherein the output shaft is disposed at the back end of the lever and supports the lever, wherein the guide mechanism includes:

a contact portion that comes in contact with the protrusion to slide the lever; and a guide portion that guides the protrusion to the contact portion, wherein the protrusion always stops at one of the first and second halting positions of the allowing means upon completion of rotation of the rotor, and wherein the front end of the lever is swingable between the first and second halting positions without operation of the motor, only when allowed by the allowing means.

2. The actuator according to claim 1, wherein the guide mechanism includes a first slide guide portion that comes in contact with the protrusion to slide the protrusion to the guide portion during rotation of the rotor in a first direction; and a second slide guide portion that comes in contact with the protrusion to slide the protrusion to the movement support portion during rotation of the rotor in a second direction, the second direction being opposite to the first direction.

3. The actuator according to claim 1, wherein the contact portion includes a first contact portion and a second contact portion that extend in different directions.

4. The actuator according to claim 3, wherein the first contact portion slides the front end of the lever to the second halting position during rotation of the rotor in a first direction, and the second contact portion slides the front end of the lever to the first halting position during rotation of the rotor in a second direction, the second direction being opposite to the first direction.

* * * * *